United States Patent [19]

Didek et al.

[11] 3,938,310

[45] Feb. 17, 1976

[54] APPARATUS FOR SEPARATING FIBERS IN OPEN-END SPINNING MACHINES

[75] Inventors: Stanislav Dídek; Jaroslav Štorek; Miloslav Kubový; Zdeněk Švec; Jan Hrdina; Jaromír Kašpárek, all of Usti nad Orlici, Czechoslovakia

[73] Assignee: Vyzkumny Ustav Bavlnarsky, Usti nad Orlici, Czechoslovakia

[22] Filed: Mar. 4, 1974

[21] Appl. No.: 448,010

[30] Foreign Application Priority Data

Mar. 8, 1973 Czechoslovakia ..... 1655-73

[52] U.S. Cl. ..... 57/58.91; 19/105; 57/58.95

[51] Int. Cl.[2] ..... D01H 1/12

[58] Field of Search ..... 57/58.89, 58.95, 50; 19/105

[56] References Cited

UNITED STATES PATENTS

| | | | |
|---|---|---|---|
| 3,335,558 | 8/1967 | Doudlebsky et al. | 57/58.95 |
| 3,439,488 | 4/1969 | Bucil et al. | 57/58.95 |
| 3,785,138 | 1/1974 | Rajnoha et al. | 57/58.95 |
| 3,826,071 | 7/1974 | Grau | 57/58.95 X |
| 3,834,148 | 9/1974 | Sakurai et al. | 57/58.95 |

*Primary Examiner*—John Petrakes

[57] ABSTRACT

Apparatus for separating fibers in open-end spinning machines, having a combing-out cylinder by which a fibrous sliver supplied by a feeding device is separated in a combing-out zone provided between a card clothing of the combing-out cylinder, and an operating wall of an insert, the cross-section of said zone decreasing, at least in the introductory portion thereof, in the fiber flow direction while the separated and combed-out fibers are conveyed through a duct into a rotary spinning chamber. The insert is provided with at least two differenly concave faces for providing different combing-out zones, said insert being adjustable into positions in which any of said concave faces is adapted to cooperate in providing the combing-out zone, the insert being held in a desired one of its respective positions.

18 Claims, 8 Drawing Figures

APPARATUS FOR SEPARATING FIBERS IN OPEN-END SPINNING MACHINES

The present invention relates to an apparatus for separating fibers in open-end spinning machines such machines comprise a combing-out cylinder by which a fibrous silver, supplied by a feeding device, is separated in a combing-out zone provided between the card clothing of the combing-out cylinder and an operating wall of an insert; the cross-section of said zone decreases, at least in the introductory part thereof, in the direction of fiber flow while the fibers once separated are conveyed through a duct into a rotary spinning chamber.

Well-known devices for separating and combing-out fibers in open-end spinning machines equipped with rotary spinning chambers operate in a quite satisfactory way when fibers of cotton type, i.e. relatively fine and short fibers, are to be processed.

Such devices usually comprise a driven feed roller and a feed table or another roller associated therewith, such two cooperating elements producing a nip passage for the sliver, due to the action of a suitable spring. A part of such a device is also constituted by the above-mentioned combing-out zone. All the parts of the fiber separating device are placed, as a rule, in a suitable recess provided in the body of the separating device.

The combing-out and fiber separating process in open-end spinning machines is carried out by a combing-out cylinder provided on its circumference with a card clothing in the form of needles or saw teeth. A fibrous sliver is supplied to this cylinder by the coaction of a feed roller and a pressure table. The latter is formed with a bending edge which is positioned adjacent the combing-out cylinder and over which the sliver, on leaving the feed roller, is bent and conveyed to a combing-out zone wherein it is separated, due to the action of the card clothing, into individual fibers which are then conveyed through a duct into the rotary spinning chamber, due to a subatmospheric pressure produced by ventilation apertures provided in the chamber wall, or by a central source of underpressure. Between the feed roller and said duct there is provided, opposite the combing-out cylinder, the inner stationary wall of the body of the separating device housing the combing-out cylinder so that fibers are conveyed up to the duct where they are removed from the card clothing of the combing-out cylinder by centrifugal force and the air stream.

A disadvantage of the above-described arrangement is that fibers are attacked by the card clothing immediately downstream of said bending edge of the pressure table, that is at the instant the leading end of fiber has passed this edge. Since, however, the fiber is held in the pressure nip, it is engaged by the teeth of the card clothing until its whole length has passed through the nip zone. As the fiber advances over said edge of the pressure table, an ever increasing length thereof is engaged by the clothing teeth so that if the intensity of this engagement attack together with the friction between the teeth and the fibers, exceeds the fiber strength, the fiber breaks. Needless to say, this breakage results in a considerable fiber degradation and consequently in lower yarn quality. The above-described disadvantage can be eliminated to some extent by another arrangement in which the feed roller together with the pressure table, i.e. also the bending edge and the wall of the separating device cavity housing the combing-out cylinder, are positioned at a greater distance from the surface of the combing-out cylinder. Beginning with the bending edge of the pressure table, the afore-said wall gradually approaches the card clothing of combing-out cylinder in the direction of its rotation up to a close proximity thereto. In this way it is made possible to reduce to some extent the rate of fiber breakage, since the fibers are not attacked immediately downstream the bending edge but are allowed to escape engagement by the teeth into the space of the so-called combing-out zone. However, it has been found out that this combing-out zone, which is of constant dimensions, is suitable only for fibers of a particular staple length, thickness, character as well as the count of the sliver to be combed out. Thus in order to process a certain fibrous material range to be combed out, some devices have been suggested in which some of the dimensions of the combing-out zone can be varied in dependance upon some properties of the supplied fibrous sliver.

Apart from this, an apparatus is known which makes it possible to accommodate the fiber separating device to variable conditions in such a way that the distance between the pressure nip zone and the end of the combing-out zone wherein the cavity housing the combing-out cylinder which is at the closest proximity to the card clothing of the combing-out cylinder can be varied by means of a position-adjustable feeding device. According to another well-known embodiment, the feeding device is supported on an adjustable slide. In accordance with still another embodiment, an exchangeably arranged insert is housed in the body of the separating device, an arcuate wall of said insert constituting the combing-out zone. In this case, the feed roller is rotatably supported on a holder adapted to swing with respect to the axis of rotation of the combing-out cylinder, the holder being resiliently forced against the sliver.

Such an arrangement has certain disadvantages in that the displacement of the feeding device encounters some problems of construction, since it has to be very rigid and precise. Additionally, as found in practice, a uniform combing-out process without undesirable shortening of the fibers depends above all upon the configuration of the combing-out zone. With this configuration in view, the concentric wall of the cavity housing the combing-out cylinder is recessed in the direction away from the center of the combing-out cylinder. Into the thus created space there is placed a block shiftable along the circumference of the combing-out cylinder; one of the walls of the block can gradually approach the clothing of the combing-out cylinder so as to form the combing-out zone. The block is adjustable and may be held in any one of a number of desired positions.

This arrangement is disadvantageous in that together with the length of the combing-out zone even its shape varies, which results in an uneven combing-out process. Downstream from the closest proximity of the cavity wall to the clothing of the combing-out cylinder there is an abrupt transition into an expanded space whereby an undesirable air whirling and deceleration of flow of the separated fiber take place, all of which unfavorably affects the finished yarn product.

In still another arrangement designed to eliminate some of the aforementioned drawbacks between the feeding device and a stationary surface there is disposed a deflecting element for defining the length of the combing-out zone. This element is embodied as a eccentric pin received in a recess provided in the circumferential wall of the cavity. The adjustment of the length of the combing-out zone is carried out by turning the pin. In this way it is possible to provide at least two positions in which the lateral borders of the combing-out zone come into the closest proximity to each other, thus providing for two different lengths of said zone.

This arrangement, however, has the disadvantage that the pin is incapable of providing a desirably gradual path of the combing-out zone with respect to the card clothing of the combing-out cylinder. Further it is disadvantageous that upon any turning of the pin the configuration of the combing-out zone is varied. Further, the space downstream of the pin, due to its expanded configuration, is responsible for the shortcomings referred to in connection with the preceding arrangement.

Apart from the afore-described drawbacks, all the arrangements hereinbefore described have a common disadvantage consisting in that they do not respect the requirement of accommodating all the basic dimensions of the combing-out zone to the properties of the supplied fibrous sliver and to the separating device.

In order to attain optimum operation in processing various types of fibrous material, it is necessary to vary both the length and the shape of the combing-out zone, its intake opening, its path from the maximum opening in the direction of fiber combing, its depth in the mentioned direction in dependance upon the fiber length, thickness and the character and the count of the sliver supplied.

It is an object of the present invention to eliminate teh aforementioned disadvantages and to provide a simple apparatus for changing the dimensions of the combing-out zone in order to secure optimum operation in processing as broad range of fiber types as possible.

The present invention provides an apparatus for separating fibers in an open-end spinning machine, said machine having combing-out cylinder by which a fibrous sliver supplied by a feeding device is separated in a combing-out cylinder and an operating wall of an insert, the cross-section of said zone decreasing, at least in the introductory par thereof, in the direction of fiber flow while the separated and combed-out fibers are conveyed through a duct into a rotary spinning chamber. In the apparatus according to the invention the insert has at least two differently concave faces for providing different combing-out zones, and said insert is displaceable into positions in which any of said concave faces is adapted to cooperate in providing the combing-out zone, and can be fixed in any one of the respective positions.

Between the operating walls there are preferably arranged partition walls of which one contacts a joint wall of a recess which merges into a cylindrical wall of a cavity housing the combing-out cylinder. It is advantageous to hold the insert in the desired position by a stop member. In accordance with another feature of the invention, the stop member is arranged in the joint wall and meshes with one of the partition walls. According to another feature, arresting recesses are formed in the partition walls, the stop member being formed with an eccentric pin extending into the arresting recess and being held by a set screw. The insert can be supported either removably or pivotally on a pin.

A plurality of possibilities in selecting the configurations of the combing-out zone is afforded by the embodiment wherein the insert has the shape of a disc with operating walls and partition walls provided at its circumference; the same is true of the embodiment wherein the operating walls and the partition walls are arranged in superposed sections with a separating wall therebetween. In the latter case the stop member meshes with the separating wall.

According to another embodiment it is preferred that the partition walls and the joint walls have the same radius. Another feature according to the invention is that the insert is accommodated in a cylindrical recess in the body, or in the cap of the separating device. The transition of the joint wall into the wall of the cavity of the body can be formed, alternatively, by a beveled edge. In accordance with still another embodiment of the apparatus, a slot for ejecting impurities is provided in at least on of the operating walls, the slot opening in the insert into a directing duct communicating with the outlet duct arranged in the body.

A number of preferred embodiments of the apparatus according to the invention are described hereinafter with reference to the accompanying drawings which, however, are not intended to limit the scope of the invention in any way. In the drawings.

Figure 1:
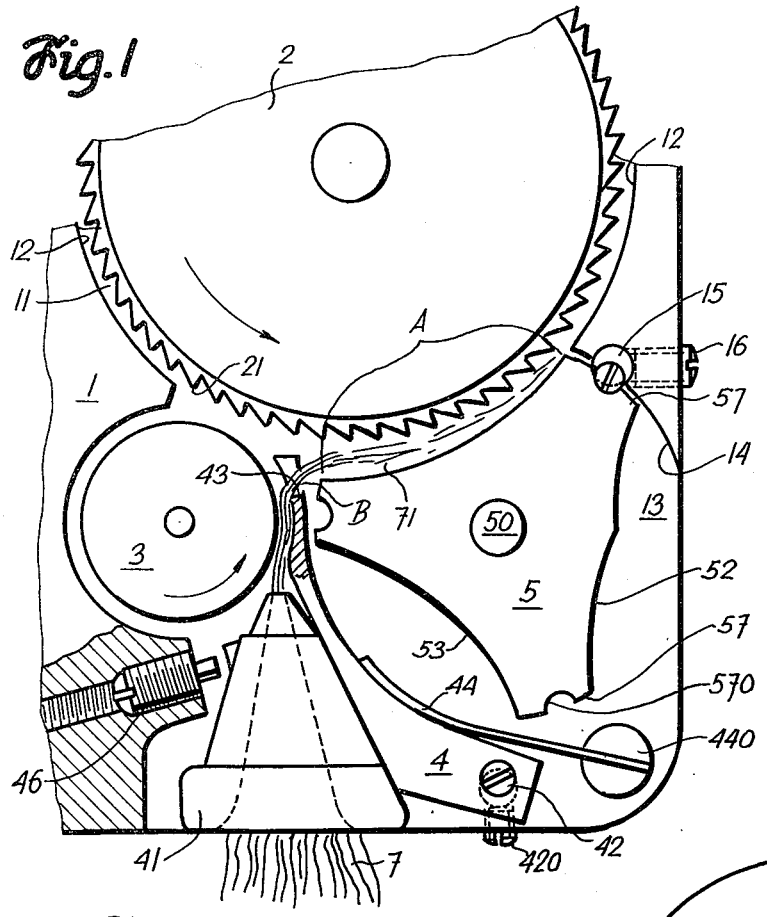
FIG. 1 is a fragmentary sectional view of the fiber separating part of the apparatus and showing the sliver feeding area and the combing-out zone.
Figure 3:
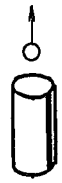
FIG. 3 is a perspective view of the fiber separating device shown in FIG. 1.

Turning now to the drawings, and particularly to FIG. 1 thereof, it can be seen that in a body 1 of the fiber separating device there is housed a driven combing-out cylinder 2 having a card clothing 21 in the form of saw wire, needles, or the like.

A feeding device in the form of feed roller 3 is associated with the combing-out cylinder 2, a pressure table 4 which is pivotally supported on a pin 42 and has an extension terminating in a bending edge 43 extending to the card clothing 21. The resilient pressure of the table 4 against the feed roller 3 is exerted here e.g. by a leaf spring 44 fixed to a pin 440, as shown in FIG. 1. Alternatively, a spring 45 the pressure of which is adjustable by means of a screw 450, as shown in the embodiment illustrated in FIG. 4, may be used instead of leaf spring 44. The range of swinging-out of the pressure table 4 in the direction towards the feed roller 3 is in turn adjustable by means of a set screw 46. In the embodiment shown in FIG. 1, the pin 42 has an eccentric portion so that by turning it and the holding by a set screw 420, the optimum position of the pressure table 4 relative to the combing-out cylinder 2 and also with respect to the feed roller can be established.

Figure 5:
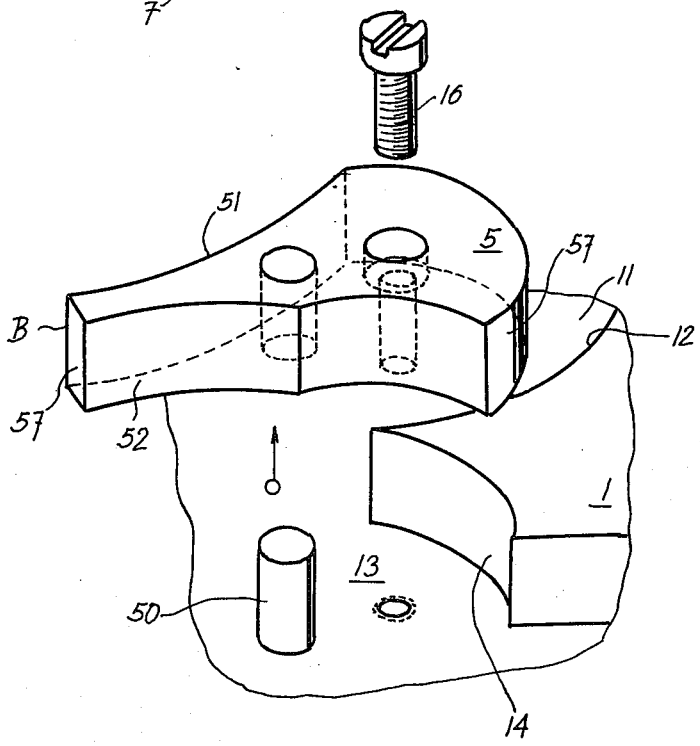
FIG. 5 is a perspective view of another embodiment of the apparatus, said apparatus having a two-position insert.
Figure 6:
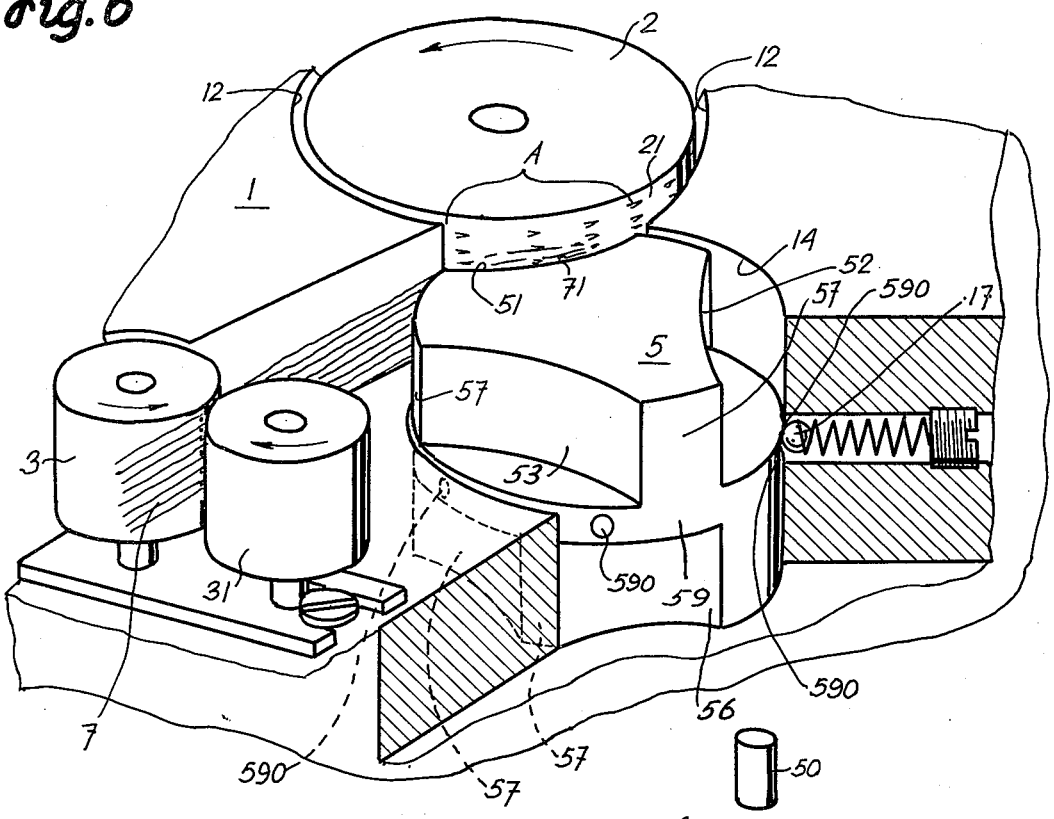
FIG. 6 is a perspective view of a six-position insert embodiment.

The combing-out cylinder 2 is housed in a cavity 11 of the body 1, the cylindrical walls 12 being arranged opposite the card clothing 21. This cavity 11 merges into a recess 13 preferably of cylindrical shape, which receives an insert 5 having either two operating walls 51 and 52, as shown in the embodiment illustrated in FIGS. 4 and 5; three operating walls 51, 52, and 53; or a plurality, for example six, operating walls, of which four (51–53 and 56) are shown in FIG. 6. It is to be understood that the concavities of the operating walls differ from one another.

The respective concavity of said operating walls 51 through 56 is of such a configuration as to form, together with the card clothing 21, a combing-out zone A of various shapes, depending upon the particular type of fibrous material to be spun. Thus for example, the concavity of the operating wall 51 (FIG. 1) has a relatively long radius of curvature so that it provides a relatively long combing-out zone A suitable for processing long-staple fibrous materials of wool character. On the contrary, the concavity of the operating wall 51′ (FIG. 4) provides a relatively short combing-out zone A′ which, however, is broad in its entrance position and is particularly suitable for separating and processing short-staple fibrous materials. The insert 5 is supported, as a rule, on a pin 50 which can be either received in the respective hole 500 in the body 1, or fixed therein. If it is necessary to vary the combing-out zone, the insert 5 is withdrawn, turned into the respective desired position, and re-mounted on the pin 50.

Figure 2:
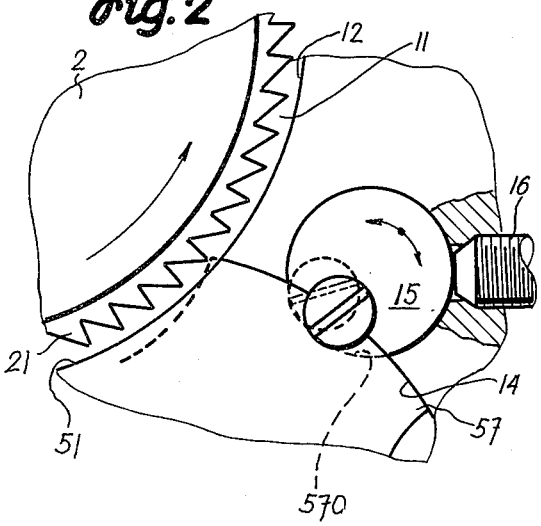
FIG. 2 is a detail view showing the insert securing means.
Figure 2:
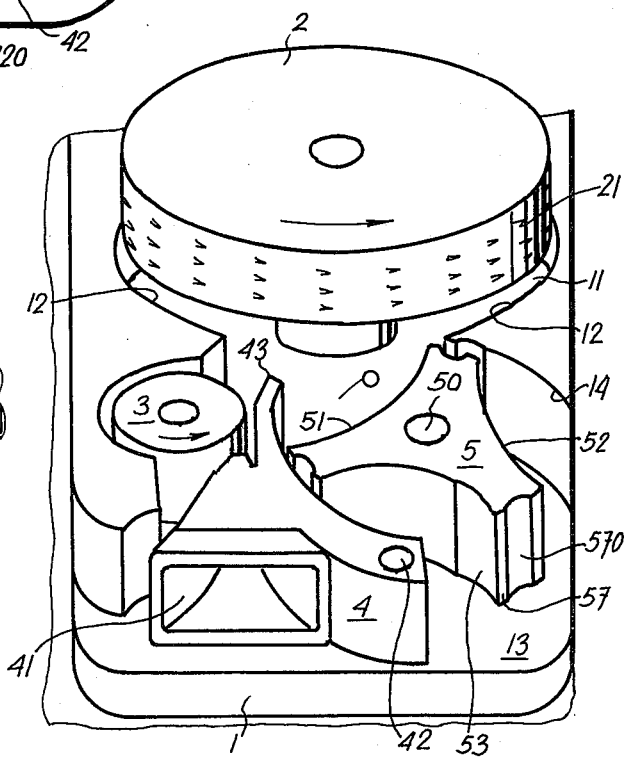

Between the operating walls partition walls 57 are formed, one of which contacts a joint wall 14 of a recess 13 merging into said cylindrical wall 12 of the cavity 11, while the joint wall 14 carries a stop member meshing with one of the partition walls 57 and arresting the insert 5 in the set-up position. This stop member can be embodied as an eccentric pin 15 extending into an arresting recess 570 of the partition wall 57 and into a corresponding recess of the joint wall 14 as shown in FIGS. 1 and 2. The eccentric pin 15 allows a fine adjustment of the required position of the insert 5 to be made. The fixing of the preset position is carried out by a set screw 16. The alternative embodiments illustrated in FIGS. 4 or 5 can be used.

Figure 7:
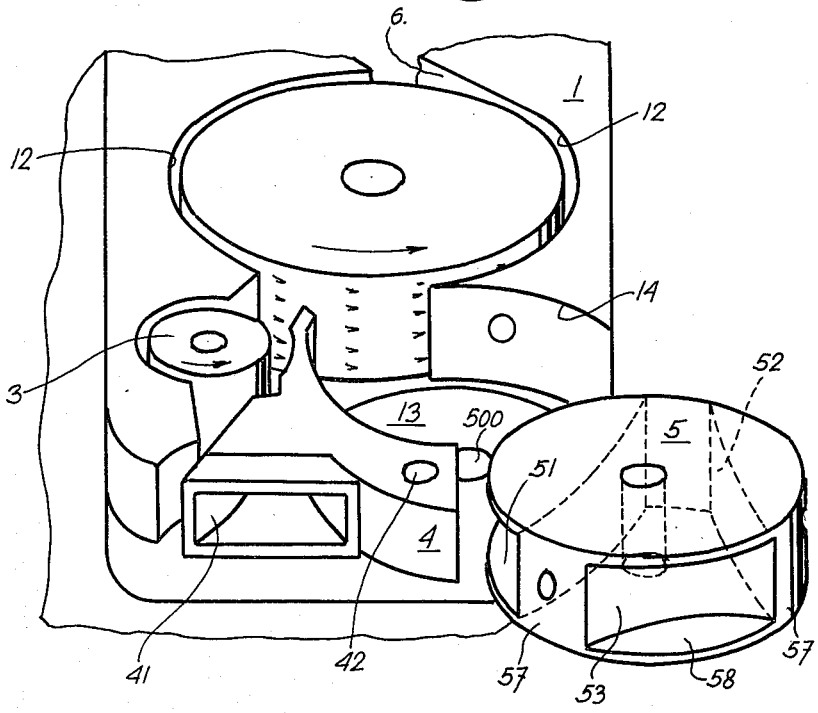
FIG. 7 is a perspective view of a disc-shaped insert removed from the apparatus for the sake of clarity.

In the embodiment as shown in FIGS. 6 and 7, the insert 5 has the form of a disc with alternating operating walls 51, 53 incl., or 56, as well as partition walls 57, arranged at the disc circumference. In the embodiment according to FIG. 7, the operating walls 51 through 53 are confined by flanges 58, in addition to the partition walls 57.

As shown in FIG. 6, the operating walls and the partition walls are arranged in superposed sections with a separating wall 59 therebetween. In such an embodiment the stop member is constituted by a spring-loaded ball pawl meshing in the arrest position into a recess in the separating wall 59. In said embodiment the feeding device comprises two feed rollers 3. The partition walls 57 and the joint wall 14 are preferably embodied as cylindrical walls of the same radius. In the embodiment illustrated in FIG. 7 the recesses are formed in the partition walls 57.

Figure 4:
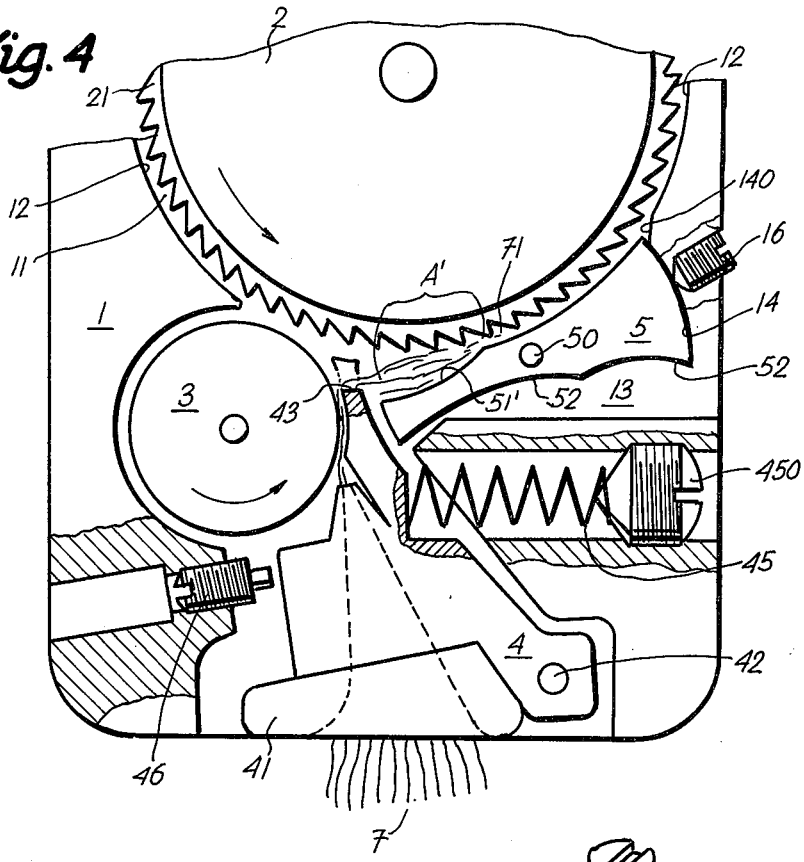
FIG. 4 is a partial view in section of the fiber separating device comprising a modified insert.

In the embodiment shown in FIG. 4, the transition of the joint wall 14 into the cylindrical wall 12 of the cavity 11 is constituted by a beveled edge 140.

The embodiment according to FIG. 1, incorporating the pin 42 having the eccentric part allows the bending edge 43 of the pressure table 4, to be position-adjusted against an edge B provided between the operating wall 51 and the joint wall 14 at the entrance of the combing-out zone A, at a distance that is either equal or less than that between said bending edge 43 and the card clothing 21 of the combing-out cylinder 2.

The cavity 11 of the body 1 merges into a duct 6 at the far end from the feeding device, which duct 6 discharges into the spinning chamber (not shown). In the wall 12 of the cavity 11, further known modifications can be made, such as communication of the duct 6 with the ambient atmosphere, or with a cleaning slot for ejecting impurities, or the like.

Figure 8:
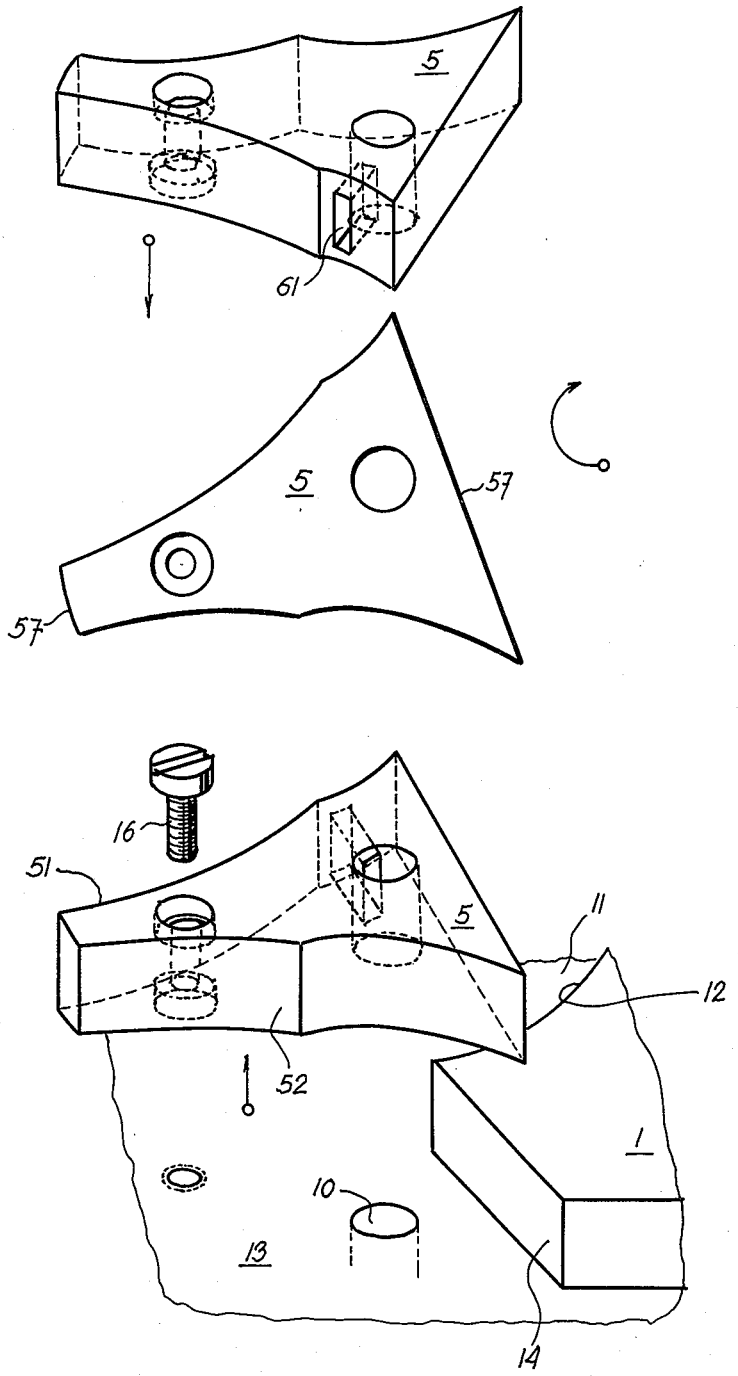
FIG. 8 is an exploded view in perspective of a two-position insert, the operating wall in one position being provided with a slot for ejecting impuritites.

According to another exemplary embodiment of the present invention, the operating wall 51 of the insert 5 (FIG. 8) is provided with a cleaning slot 61 operating in a known way and arranged at the edge of the operating wall 51 adjacent the transition of said wall into the wall 12 in the operating position, said slot 61 communicating with a suitable directing duct (not shown) which duct can communicate either with the ambient atmosphere of the spinning mill, or with a source of superatmospheric air pressure (not shown).

It is evident that not all of the parts as hereinbefore referred to as being accommodated in the recess or cavity of the body 1 of the fiber separating device, necessarily have to be received in said recess or cavity. Such parts can partially extend also into the corresponding recesses or cavities provided in the cap (not shown) covering the body 1 of the fiber separating device.

When the insert 5 with a reduced number of operating walls is used, the machine can be delivered together with spare inserts provided with additional operating walls capable to ensure optimum combing-out and separating process, with a broad range of fibers to be processed in view.

In operation, a fibrous sliver 7, due to the action of the feed roller 3 and to the pressure exerted by the pressure table 4, is drawn through the condenser 41 and passed over the bending edge 43 into the combing-out zone A in which the needles or teeth of the card clothing 21 separate it into individual fibers 71 which are conveyed, upon a pneumomechanical principle, through the duct 6 into a twist forming mechanism, such as well-known rotary spinning chamber, in which they are twisted to form yarn.

In case of change of the stock to be spun, the insert 5 is positioned opposite the card clothing 21 so that one of its operating walls corresponds to the characteristics of the fibrous material to be processed in order to achieve optimum combing-out conditions without damaging the fibers. If required, the insert can be turned in such a manner so as to face the combing-out zone by its operating wall provided with the slot 61 for ejecting impurities.

Although the invention is illustrated and described with reference to a plurality of preferred embodiments thereof, it is to be expressly understood that it is in no way limited to the disclosure of such a plurality of preferred embodiments, but is capable of numerous modifications within the scope of the appended claims.

What is claimed is:

1. In an apparatus for separating fibers in open-end spinning machines, comprising a housing having a cavity, a combing-out cylinder mounted in the cavity and having on its periphery a card clothing by which a fibrous sliver supplied by a feeding device is separated, and means including an insert disposed in the cavity and positionable adjacent the periphery of the combing-out cylinder for defining with said periphery a combing-out zone, the cross-section of a portion of said zone decreasing in the fiber flow direction, the improvement wherein the insert defines, with the adjacent portion of the cylinder periphery, an input portion only of the combing-out zone, and wherein the insert comprises, in combination, at least two peripherally spaced concave operating faces cooperable with the cylinder periphery for providing different combing-out zones therebetween, means for peripherally adjusting said insert into positions in which any desired one of said concave operating faces cooperates with the cylinder periphery to provide the combing-out zone, and means for holding the insert in its adjusted position.

2. Apparatus as defined in claim 1, in which the cavity has a first cylindrical wall having a recess therein, and in which the insert further comprises a plurality of partition walls individually disposed between the operating walls, at least one of partition walls contacting the recess in the first cylindrical wall.

3. Apparatus as defined in claim 2, wherein a stop member is arranged in the recess in the first wall and meshes with one of the partition walls.

4. Apparatus as defined in claim 3, comprising arresting recesses formed in the partition walls.

5. Apparatus as defined in claim 4, wherein the holding means comprises an eccentric pin extending into the arresting recess, and wherein the apparatus further comprises a set screw for arresting the eccentric pin.

6. Apparatus as defined in claim 2, wherein the insert has the shape of a disc.

7. Apparatus as defined in claim 6, further comprising flanges separate from the partition walls for confining at least one side of the operating walls.

8. Apparatus as defined in claim 6, in which the housing is further provided with a cap, and in which the insert is accommodated in a cylindrical recess in the cap.

9. Apparatus as defined in claim 6, wherein the insert is accommodated in a cylindrical recess in the body of the fiber separating device.

10. Apparatus as defined in claim 2, wherein the operating walls and the partition walls are arranged in superposed sections with a separating wall therebetween.

11. Apparatus as defined in claim 10, wherein a stop member meshes with the separating wall.

12. Apparatus as defined in claim 2, wherein the partition walls and the first wall have complementary cylindrical shapes of like radius.

13. Apparatus as defined in claim 2, in which the combing-out defining means further comprises a second cylindrical wall of the cavity, and means including a bevelled surface for interconnecting the first and second cylindrical walls.

14. Apparatus as defined in claim 1, wherein the means for holding the insert in the desired adjusted position is a stop member.

15. Apparatus as defined in claim 1, wherein at least one of the operating walls is provided with a slot for ejecting impurities.

16. Apparatus as defined in claim 15, wherein the insert has an internal duct communicating with the slot.

17. Apparatus as defined in claim 1, further comprising pin means for removably supporting the insert in the cavity.

18. Apparatus as defined in claim 1, further comprising pin means for pivotally supporting the insert in the cavity.

* * * * *